United States Patent [19]

Asai

[11] 4,232,646

[45] Nov. 11, 1980

[54] IGNITION SYSTEM FOR INTERNAL COMBUSTION ENGINES WITH A MAGNETO GENERATOR

[75] Inventor: Masahiro Asai, Hekinan, Japan

[73] Assignee: Nippondenso Co., Ltd., Kariya, Japan

[21] Appl. No.: 41,302

[22] Filed: May 22, 1979

[30] Foreign Application Priority Data

May 24, 1978 [JP] Japan ..... 53-62108

[51] Int. Cl.[3] ..... F02P 3/08

[52] U.S. Cl. ..... 123/600; 123/149 C; 123/605; 315/209 CD; 315/209 SC; 315/218

[58] Field of Search ..... 123/148 CC, 148 E, 149 C; 315/209 CD, 209 SC, 218

[56] References Cited

U.S. PATENT DOCUMENTS

| | | | |
|---|---|---|---|
| Re. 29,374 | 8/1977 | Just et al. | 123/148 CC |
| 3,941,110 | 3/1976 | Sekiguchi | 123/148 CC |
| 4,010,726 | 3/1977 | Kondo et al. | 123/148 CC |
| 4,079,712 | 3/1978 | Nagasawa | 123/148 CC |
| 4,149,509 | 4/1979 | Mathieu | 123/148 CC |
| 4,150,652 | 4/1979 | Nagasawa | 123/148 CC |

*Primary Examiner*—Charles J. Myhre
*Assistant Examiner*—Andrew M. Dolinar
*Attorney, Agent, or Firm*—Cushman, Darby & Cushman

[57] ABSTRACT

An ignition system for internal combustion engines in which a capacitor is charged at each one-polarity half-cycle of the output of a magneto generator and then the capacitor is discharged through a thyristor and a primary coil of an ignition coil when the thyristor is turned on. To turn on the thyristor, a gate-cathode current is supplied through a semiconductor switching element from an auxiliary capacitor which is charged by a timing generator which generates an output prior to only a predetermined ignition time. Although the semiconductor switching element is turned on by an ignition signal generating means, for example, a transformer, when the transformer produces an ignition signal at each the other-polarity half-cycle of the magneto generator output, the gate-cathode current is supplied to the thyristor only when the auxiliary capacitor has been charged by the timing generator.

3 Claims, 4 Drawing Figures

IGNITION SYSTEM FOR INTERNAL COMBUSTION ENGINES WITH A MAGNETO GENERATOR

The present invention relates to improvements in the construction of ignition systems for internal combustion engines of the type employing a magneto generator as a power source.

In a known ignition system of this type, a capacitor is charged through a diode by the output of the capacitor charging coils of a magneto generator and the output of the capacitor charging coils is converted by ignition signal generating means to an ignition signal to turn on a thyristor, whereby in response to the conduction of the thyristor the electric charge stored in the capacitor is discharged through the primary winding of an ignition coil and an ignition spark is produced at the proper spark plug. Where a magneto generator having four or more magnetic poles is used, two or more ignition signals are generated for each revolution of the magneto generator and consequently undesired ignition sparks are produced at the spark plugs, thus making it necessary to eliminate the undesired capacitor charge stored for each revolution of the engine, to make ineffective the undesired charging of the capacitor and to eliminate the undesired ignition signals.

A disadvantage of the above-mentioned system of the type designed to eliminate the undesired capacitor charge and ignition signals and to make ineffective the undesired charging of the capacitor is that the generated output of the capacitor charging coils, ignition signals, charged capacitor voltage and control signals for eliminating and invalidating purposes vary according to the engine rotational speed thus making it difficult to eliminate the undesired charged capacitor voltage and ignition signals and invalidate the undesired capacitor charging throughout the range of engine rotational speeds, and moreover to meet these requirements positively requires an increase in the duration of such elimination and invalidation control signals with the resulting disadvantages of also eliminating the desired charged capacitor voltage and ignition signals and invalidating the desired capacitor charging.

It is therefore the object of the present invention to provide an ignition system for internal combustion engines in which the ignition of an engine is effected only when an ignition signal is generated after a timing generator has generated an output so as to positively effect the ignition only at the desired position throughout the whole range of rotational speeds of a magneto generator.

In the present invention, an auxiliary capacitor is charged through a diode by the output of a timing generator adapted to generate a signal which leads in phase an ignition signal at the time of ignition and the electric charge stored in the auxiliary capacitor is applied to the gate of a thyristor through an auxiliary semiconductor switching device adapted to be turned on by the ignition signal.

Thus the ignition system of this invention has among its great advantages the fact that since the number of times of ignition can be positively determined by the frequency of occurrence of an output from a timing generator per revolution of a magneto generator, since the angle of spark advance can be determined as desired according to the generated output of ignition signal generating means adapted to convert the output of capacitor charging coils to an ignition signal and since there is no danger of causing misfiring unless the charging of a capacitor is interferred by the time of discharge of the stored charge of an auxiliary capacitor due to the conduction of an auxiliary semiconductor switching element, the occurrence of any malfunction can be prevented easily irrespective of the duration of an output signal of the ignition signal generating means, and moreover since it is only necessary that the magneto generator generates an output prior to the ignition signal generating means when the ignition is to be effected, there is no need to exactly synchronize the output of the magneto generator with the output of the ignition signal generating means and consequently the output signal duration of the magneto generator can be made very small.

For a better understanding of the present invention, reference is made to the following description and accompanying drawings, in which.

Figure 1:
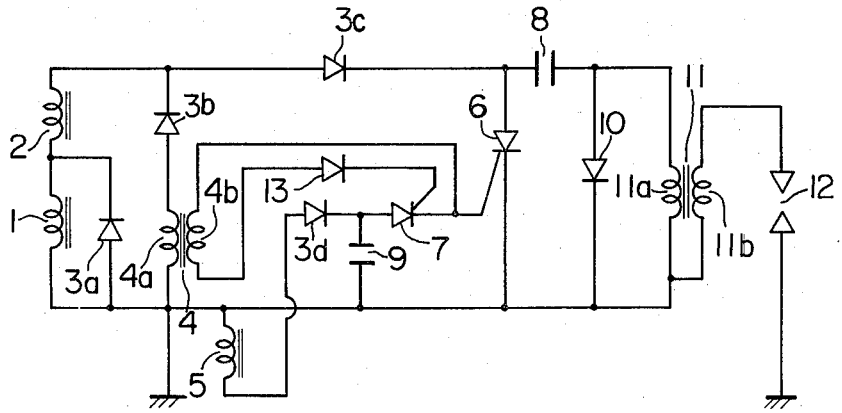
FIG. 1 is a circuit diagram showing an embodiment of an ignition system according to the invention.

The present invention will now be described in greater detail with reference to the illustrated embodiment. In the circuit diagram of FIG. 1, numerals 1 and 2 designate low-speed and high-speed capacitor charging coils of a magneto generator which are connected in series with each other, 3*a* a diode connected in inverse parallel with the low-speed capacitor charging coil 1, and 3*b*, 3*c* and 3*d* diodes. Numeral 4 designates a transformer having a primary winding 4*a* and a secondary winding 4*b* and connected between the terminals of the capacitor charging coils 1 and 2 through the diode 3*b* connected with such polarity as to flow a reverse output. Numeral 5 designates the signal coil of a timing generator, 6 a thyristor having its anode connected to the high-speed capacitor charging coil 2 through the diode 3*c* and its cathode connected to the ground, and 7 an auxiliary thyristor having its anode connected to the signal coil 5 through the diode 3*d* and its cathode connected to the gate of the thyristor 6. Numeral 8 designates a capacitor having its one end connected to the junction of the cathode of the diode 3*c* and the anode of the thyristor 6, and 9 an auxiliary capacitor having its one end connected to the junction of the cathode of the diode 3*d* and the anode of the auxiliary thyristor 7 and the other end connected to the ground. Numeral 10 designates a diode having its anode connected to the other end of the capacitor 8 and its cathode connected to the ground, 11 an ignition coil having a primary winding 11*a* and a secondary winding 11*b* and connected between the junction of the capacitor 8 and the diode 10 and the ground, 12 a spark plug connected to the secondary side of the ignition coil 11, and 13 a diode connected between the secondary winding 4*b* of the transformer 4 and the gate-cathode circuit of the auxiliary thyristor 7.

Figure 2:
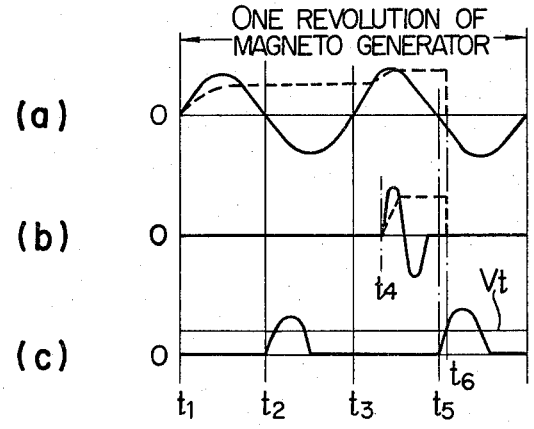
FIG. 2 is a waveform diagram which is useful in explaining the operation of the embodiment shown in FIG. 1.
Figure 3:
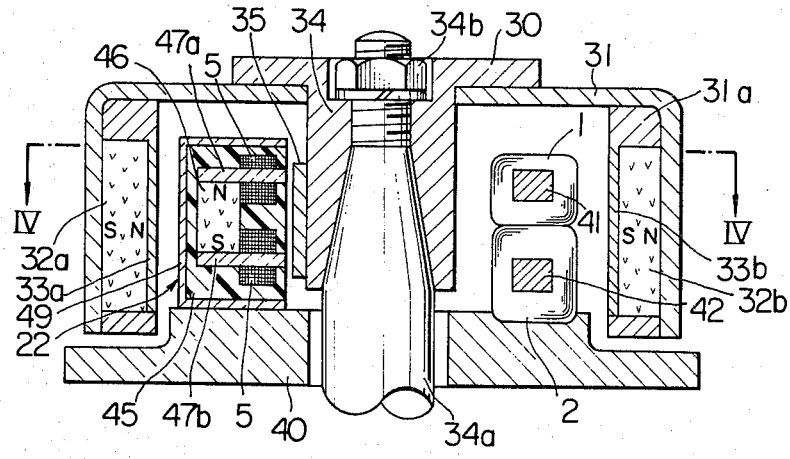
FIGS. 3 and 4 show an exemplary form of a magneto generator adapted for use with the embodiment shown in FIG. 1, with FIG. 3 showing a longitudinal sectional view taken along the line III—III of FIG. 4 and FIG. 4 showing a cross-sectional view taken along the line IV—IV of FIG. 3.
Figure 4:
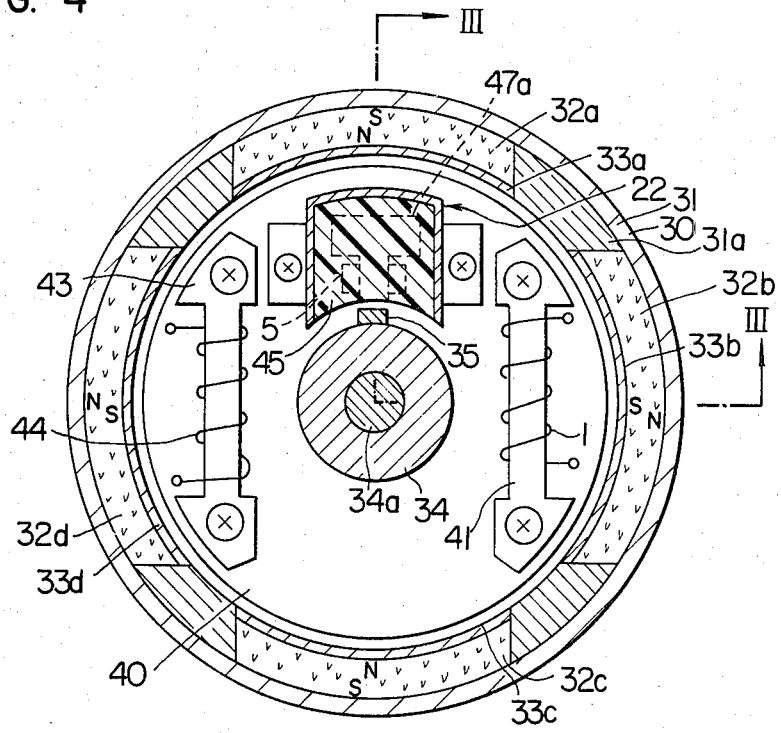

The construction of the previously-mentioned magneto generator will now be described with reference to FIGS. 3 and 4 in which numeral 30 designates a rotor comprising an iron shell 31, four permanent magnets 32*a*, 32*b*, 32*c* and 32*d* which are equally spaced on the inner surface of the iron shell 31 and fixedly embedded in place by means of a nonmagnetic material 31*a* such as aluminum or resin material, pole pieces 33*a*, 33*b*, 33*c* and 33*d* respectively secured to the inner surface of the permanent magnets 32*a*, 32*b*, 32*c* and 32*d*, a center piece 34 fixedly mounted on an engine crankshaft 34*a* with a nut 34*b* and securely joined with the iron shell 31 by means of rivets which are not shown and a timing core 35 attached to the center piece 34. Numeral 40 designates a stator fixedly mounted to the engine. Numerals 41 and 42 designate capacitor charging cores which are placed one upon another and fixedly mounted in the same position on the stator 40, and the capacitor charging coils 1 and 2 are respectively wound on the cores 41 and 42. Numeral 43 designates a lamp load core which is fixedly mounted on the stator 40 at a position opposite to or spaced apart by about 180° from the position of the capacitor charging cores 41 and 42, and wound on the core 43 is a lamp load supply coil 44 constituting a power supply for a load, such as a lamp. Numeral 22 designates the stator of the previously mentioned timing generator which is fixedly mounted on the stator 40 at a position spaced apart by about 90° from the capacitor charging cores 41 and 42, and it comprises a permanent magnet 46, cores 47*a* and 47*b* arranged on both sides of the magnet 46, the signal coil 5 wound on the cores 47*a* and 47*b*, a case 49 housing these elements and a sealing resin 45 placed in the case 49. With the magneto generator constructed in the manner described, two cycles of a no-load alternating voltage are generated in the capacitor charging coils 1 and 2 as shown by the solid line in (a) of FIG. 2 for each revolution of the magneto generator or each revolution of the engine crankshaft 34*a*, and consequently one cycle of a no-load output voltage is generated in the timing generator signal coil 5 as shown by the solid line in (b) of FIG. 2 in response to the generation of the second cycle positive half wave from the capacitor charging coils 1 and 2 during each revolution of the crankshaft 34*a*.

With the construction described above, the operation of the system of the invention is as follows. When the generated output of the low-speed and high-speed capacitor charging coils 1 and 2 increases in a capacitor charging direction at a time $t_1$ in FIG. 2, the capacitor 8 is charged as shown by the broken line in (a) of FIG. 2 through a circuit comprising the diode 3*c*, the capacitor 8 and a parallel circuit of the diode 10 and the primary winding 11*a* of the ignition coil 11. Then, when the generated voltage of the capacitor charging coils 1 and 2 increases in the opposite or noncharging direction at a time $t_2$ in FIG. 2, a current flows to the primary winding 4*a* of the transformer 4 through a circuit comprising the primary winding 4*a* of the transformer 4 and the diode 3*b*, so that an output voltage is produced in the secondary winding 4*b* and the gate voltage shown in (c) of FIG. 2 is applied to the auxiliary thyristor 7 through a circuit comprising the diode 13 and the gate-cathode circuit of the auxiliary thyristor 7. In this case, however, there is no stored charge in the auxiliary capacitor 9 and consequently the auxiliary thyristor 7 is not turned on.

When the generated voltage of the capacitor charging coils 1 and 2 again increases in the capacitor charging direction at a time $t_3$ in FIG. 2, the capacitor 8 is again charged. Then, the output shown by the solid line in (b) of FIG. 2 is generated in the signal coil 5 of the timing generator at a time $t_4$ in FIG. 2 at which the capacitor charging half-wave output is being generated from the capacitor charging coils 1 and 2 and this signal coil output charges the auxiliary capacitor 9 through the diode 3*d* as shown by the broken line in (b) of FIG. 2.

Then, when the generated voltage of the capacitor charging coils 1 and 2 again increases in the non-charging direction at a time $t_5$ in FIG. 2 so that an output voltage is generated in the secondary winding 4*b* of the transformer 4 and the gate voltage shown in (c) of FIG. 2 is applied to the auxiliary thyristor 7, at the instant that the gate voltage exceeds a gate trigger level $V_t$ the auxiliary thyristor 7 is turned on at a time $t_6$ in FIG. 2 and the charge stored in the auxiliary capacitor 9 is applied to the gate of the thyristor 6 through the auxiliary thyristor 7. When this occurs, the thyristor 6 is turned on at the time $t_6$ in FIG. 2 so that the charge stored in the capacitor 8 is discharged into the primary winding 11*a* of the ignition coil 11 through the thyristor 6 and a high voltage is generated in the secondary winding 11*b*, thus producing an ignition spark at the spark plug 12.

By repeating the above-mentioned process, it is possible to produce ignition sparks at the spark plug 12, one for each revolution of the magneto generator.

In this case, since the time of generation of an ignition spark is determined by the generated output of the transformer 4, it is possible to control the spark timing by utilizing the fact that the generated output of the transformer 4 varies with an increase in the rotational speed, and moreover since the generated voltage of the timing generator signal coil 5 determines whether the ignition is to be effected and it is not intended to directly determine the time of ignition, the generated voltage needs not have a high degree of accuracy.

While, in the embodiment described above, the thyristor 7 is used as the auxiliary semiconductor switching device, any other semiconductor switching device such as a transistor may be used.

Further, while, in the above-described embodiment, the magneto generator of the 4-pole type is used, it is possible to use a magneto generator having 6 or more poles. Where a magneto generator with 6 or more poles is used, the system is not limited to the operation of effecting the ignition only once for each revolution of the magneto generator and it is possible to effect the ignition two or more times by causing the timing generator signal coil 5 to generate the required output signal as many times as desired.

Further, while, in the above-described embodiment, the noncharging direction half-wave output of the capacitor charging coils 1 and 2 is converted to an ignition signal by the ignition signal generating means comprising the transformer 4, the capacitor charging half-wave output of the capacitor charging coils 1 and 2 may be converted to an ignition signal. Moreover, the ignition signal generating means is not limited to the transformer 4 and any other means may be used provided that the output of the capacitor charging coils 1 and 2 can be converted to an ignition signal.

We claim:

1. An ignition system for internal combustion engines comprising:

a magneto generator having a coil for inducing therein an output in synchronism with the rotation of a crank shaft of an internal combustion engine, a capacitor connected to said coil of said magneto generator through a diode and being charged by the output produced in said coil, an ignition coil having a primary coil connected to said capacitor and having a secondary coil connected to an ignition plug, a thyristor connected in series with said capacitor and said primary coil of said ignition coil to form a discharging path of said capacitor, an auxiliary semiconductor switching element connected to a gate of said thyristor, means for converting an output of said coil of said magneto generator into an ignition signal and for applying said ignition signal to a gate of said auxiliary semiconductor switching element, a timing generator for generating an output in synchronism with the rotation of the crank shaft of said internal combustion engine advanced in phase with respect to a predetermined ignition signal, said auxiliary semiconductor switching element being turned on upon occurence of said predetermined ignition signal, and an auxiliary capacitor connected to said timing generator to store an output thereof and having a discharging path including said auxiliary semiconductor switching element and a gate-cathode circuit of said thyristor thereby to apply a discharging current of said auxiliary capacitor to said gate-cathode circuit of said thyristor only when said auxiliary capacitor has been charged and said auxiliary semiconductor switching element is turned on by a successive ignition signal.

2. An ignition system according to claim 1 wherein said capacitor is charged by each one-polarity half-cycle of the output of said magneto generator, and said converting means comprises a transformer to produce said ignition signal at each the other-polarity half-cycle of the output of said magneto generator.

3. An ignition system according to claim 1 wherein said timing generator and said magneto generator are disposed each other with respect to the crank shaft of said internal combustion engine such that said timing generator generates one cycle of output in a predetermined one-polarity half-cycle of the output of said magneto generator for each revolution of said crank shaft.

* * * * *